United States Patent [19]

Norikane

[11] Patent Number: 4,580,020

[45] Date of Patent: Apr. 1, 1986

[54] DYNAMIC SEAL FOR GAS GENERATOR CHAMBER

[76] Inventor: Kiyoshi Norikane, 83 Winslow St., Park Forest, Ill. 60466

[21] Appl. No.: 650,849

[22] Filed: Sep. 17, 1984

[51] Int. Cl.[4] ..... H01H 35/38; H01H 33/42

[52] U.S. Cl. ..... 200/82 B; 200/148 R; 200/148 F

[58] Field of Search ..... 200/148 R, 82 B

[56] References Cited

U.S. PATENT DOCUMENTS

| | | | |
|---|---|---|---|
| 4,251,701 | 2/1981 | Meyer | 200/82 B |
| 4,342,978 | 8/1982 | Meister | 200/82 B |
| 4,451,717 | 5/1984 | Crookston et al. | 200/82 B |

*Primary Examiner*—Robert S. Macon

[57] ABSTRACT

In an electric circuit interrupter actuator which utilizes gas generator chambers to activate a power cylinder to provide opening and closing of the interrupter, an improved dynamic seal is provided. Such seal works in the reverse direction of an obturator of, for example, a machine gun or artillery piece in that a slidable spring biased sealing ring is provided in the input port to the power cylinder which successively seals with the gas generator chambers which are rotated by it. In order to overcome the friction forces of the initial high velocity gas flow which would otherwise force the ring out of sealing contact, a spring washer is provided having sufficient force to overcome this initial friction force. Thereafter, the high pressure gas exerts a force on the end of the ring in a direction opposite the gas flow to force the sealing ring into tighter engagement. Also, the natural circumferential expansion of the sealing ring, due to the high pressure, promotes radial sealing.

12 Claims, 3 Drawing Figures

DYNAMIC SEAL FOR GAS GENERATOR CHAMBER

The present invention is directed to a dynamic seal between a gas generator chamber and the chamber of a power cylinder for opening and closing an electric circuit interrupter.

As described in a co-pending application entitled ACTUATOR FOR AN ELECTRICAL CIRCUIT INTERRUPTER, in the names of Ronald Crookston and Hayes Dakin, Ser. No. 664,989, filed Oct. 26, 1984, there is disclosed an actuator for an electric circuit interrupter which includes a storage magazine for storing and supplying a plurality of chemical gas generating power units which may be similar to shotgun shells. A power cylinder derives mechanical energy for operating the circuit interrupter from the high pressure gas flow created by the combustion of the chemical propellant material. Finally, details of the rotary turret head for receiving the stored power units, rotating them into an operating position, and then ejecting spent power units is illustrated.

In that type of system, where high pressure gas generation is present, and especially in a system where fast repeated actuations are required, the gas generator chamber is usually separated from the cylinder in which mechanical energy is derived. The interface between these two components must then be sealed to contain the high pressure gas.

Well known analogous apparatus are guns or artillery where it is desired to fire off several rounds of ammunition in a very short period of time. For example, in the M39 machine gun, the barrel of the gun is separate from the ammunition chamber which is a revolving cylinder which has chambers for six rounds of ammunition. Here there is a sleeve like sealing ring in each of the gas generating chambers. Thus, when the shell is fired, the seal is caused to travel in the same direction as the projectile and the hot gases to thus seal or obturate the chamber barrel interface. In other words, the gas pressure, acting on the back end of the ring type seal plus a frictional force created by the high velocity gas flowing through the seal causes it to move into engagement with the gun barrel.

In the projectile field, an obturator is a dynamic seal device for stopping the escape of gas in a gun breech while firing. While this type of seal works well, it is costly and for repetitive action with many rounds adds significant weight and cost to the system. And, of course, an electrical circuit interrupter system is quite different from an artillery piece or naval gun.

Thus, it is an object of the present invention to provide an improved dynamic seal for a gas generator chamber when used in the context of an electric circuit interrupter.

In accordance with the above object, there is provided in an actuator for an electric circuit interrupter a plurality of gas generator chambers each having an exit port and having a high velocity gas flow therefrom. A power cylinder derives mechanical energy for operating the circuit interrupter from the developed gas pressure. It has an input port of similar configuration to the exit port of the chambers which are successively juxtaposed with the input port. There are provided sealing means forming part of and slidable in the input port having an annular surface for sealing engagement with an exit port and including a spring means for biasing the surface against the exit port and providing a predetermined force greater than the frictional force created by the high velocity gas flow from the exit port.

From a method standpoint, there is provided a method of activating a power cylinder having an input port and which operates an electric circuit interrupter with the use of a plurality of gas generator chambers each having an exit port having a high velocity gas flow therefrom for developing a high gas pressure. The method comprises the steps of successively juxtaposing the exit port of a gas generator chamber with the input port of the power cylinder and providing a sealing ring slidable in the input port which has an annular surface at one end for sealing engagement with the exit port. The slidable ring is biased with a spring force greater than the friction force caused by the high velocity gas flow from the exit port when the juxtaposed gas generator is operated. This provides an initial sealing action; as the gas flow continues, the pressure build-up within the power cylinder gas chamber works against the other end of the sealing ring to increase the bias force and create a higher contact pressure at the interface between the sealing ring and the power unit pressure chamber. As the gas pressure increases, it causes circumferential expansion of the sealing ring which reduces the clearance between the outer surface of the sealing ring and the wall of the input port. To further prevent gas from escaping through this interface, there are a plurality of annular gas check grooves in the outer periphery of the sealing ring. Turbulence created by these grooves further retard gas flow between the ring and the input port wall.

Figure 1:
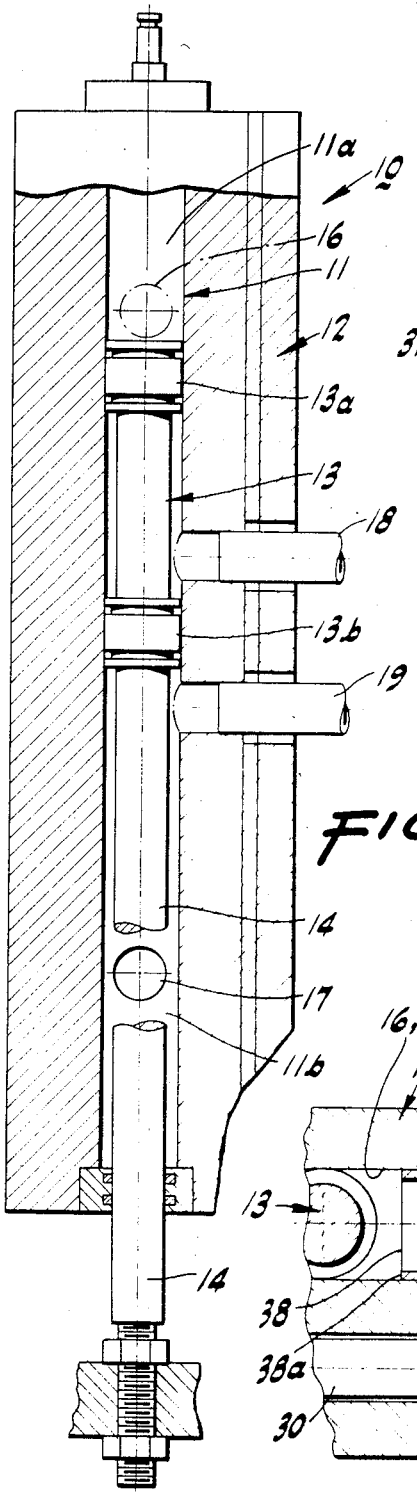
FIG. 1 is a cross-sectional view of a power cylinder utilized in the present invention.

FIG. 1 shows the details of the power cylinder which derives mechanical energy from a high velocity gas flow which develops a high gas pressure for operating an electrical circuit interrupter. Specifically, the power cylinder 10 includes a cylinder chamber 11 having a cylinder wall 12 along with a duplex piston 13 with a piston rod 14. The rod 14 is connected to an electrical circuit interrupter by standard techniques as illustrated, for example, in U.S. Pat. No. 4,251,701. When, rod 14 moves down, it opens the interrupter and up closes it. This is accomplished by the movement of the duplex piston 13 which has an open piston **13*a* and a close piston 13*b*. In order to actuate the open piston 13*a*, there is an open gas input port 16 which extends through the cylinder wall 12 and there is a close gas input port 17 similarly for the close piston 13*b*. As more particularly shown in the above Crookston et al co-pending application, the input ports 16 and 17 are on opposed sides of the cylinder 12. Both the opening and close chamber portions 11*a* and 11*b* have their own dedicated vents 18 and 19** respectively.

Figure 2:
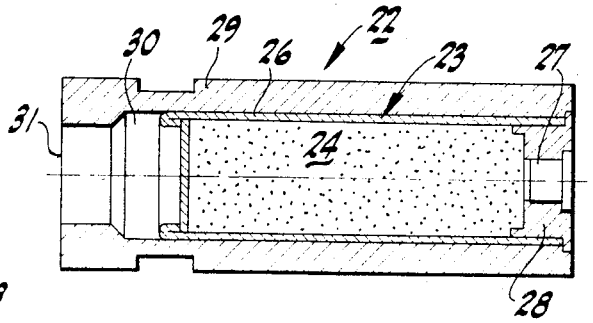
FIG. 2 is a cross-sectional view of a power unit used in the present invention along with a portion of the dynamic seal.

FIG. 2 illustrates a typical power unit 22. A power unit cartridge 23 consists of a casing 26 which may be a metal, plastic or cardboard tube with an end cap 28. The case is filled with propellant 24 and has an initiator 27 in the end cap 28. The purpose of the cartridge is to supply high pressure gas to provide operating energy for the power cylinder 10. A co-pending application in the names of Crookston et al entitled ACTUATOR FOR ELECTRICAL CIRCUIT INTERRUPTER USING NITROCELLULOSE TYPE SOLID PROPELLANT, Ser. No. 665,021, filed Oct. 26, 1984, discloses details of the optimum type of cartridge.

Cartridge 23 is fitted or slid into a metal cylindrical sleeve 29 which serves as the operating or pressure chamber for the shell. It is slid into sleeve 29 in the same manner as a shell might be placed in the breech of a shotgun. The opening 31 at the opposite end is the exit port of the pressure chamber 30. And this is what must be juxtaposed with both input ports 16 and 17 of the power cylinder 10 to provide a high pressure gas flow from the power unit to initiate mechanical movement of the piston 13; and in an open or close direction depending on which input port is energized.

Figure 3:
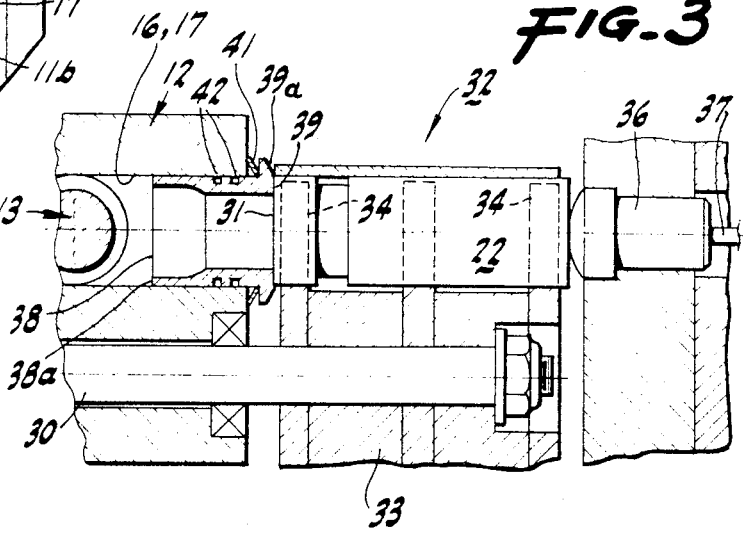
FIG. 3 is cross-sectional view showing the mating of the power unit with the power cylinder and the dynamic seal of the present invention.

In order to successively juxtapose the exit port 31 of a power unit or gas generator chamber with the input ports 16 or 17 of the power cylinder, there is provided, as shown in FIG. 3, a transfer means 32 including a rotary turret head 33 in which there are three circular cutouts to receive the cylindrical power units 22. One of these is shown at 34 as receiving the power unit 22. Such turret head and its function is more completely disclosed and claimed in the above co-pending Crookston et al "actuator" application. Rotation of the turret 33 is accomplished by a shaft 30 which extends through the cylinder wall 12 as more fully shown in such co-pending Crookston et al application. Turret head 33 and the overall transfer means 32 receives the power units 22 from a storage magazine, rotates the power unit into the operating position shown in FIG. 3 and after the cartridge has been operated, ejects it. In the operating position, the power unit 22 is juxtaposed with an initiator unit 36 which is connected via wires 37 to the control circuit which would be energized when it is desired to open or close the interrupter.

There is also illustrated a portion of the cylinder wall 12 having either the open or close gas input port 16 or 17; whichever is the case. In accordance with the invention, there is a metal ring 38 which is slidable in the input port 16 or 17. It includes on the end adjacent the power unit 22 an annular surface 39 which is of a larger inner diameter than the exit port 31.

For example, the inner diameter of annular surface 39 (which is, of course, the same as the inner diameter of ring 38 at that end) is 0.725 inches. This is greater than the 0.617 I.D. of exit port 31. Also, alignment of the sealing surface with the exit port is less critical. Surface 39 includes a tapered edge **39*a*** to reduce the sealing area and thus increase the sealing pressure with a given force.

Surface 39 is forced into sealing engagement with the exit port 31 of the power unit 22 by a wave spring washer 41 which is installed around the sealing ring in the space between the outside surface of the cylinder wall 12 and the other side of the annular surface or collar 39. This wave spring washer provides a predetermined force greater than the frictional forces created by the high velocity of the gas flow from the exit port 31 of the power unit.

To prevent gas from escaping between the interface between the input port walls 16,17 and the periphery of the sealing ring, there are a plurality of gas check grooves 42 in its periphery. The turbulence which is created, thus, retards the flow of gas between the ring and the input port wall.

Wave spring washer 41 may be in the form of a disc with three lobes. Also, other types of springs may be suitable. A suitable washer is available from Associated Springs Division of Brown's Group, Inc. of Bristol, Conn. As stated above, a spring force is necessary that is sufficient to overcome the friction forces created by the gas flow going, as illustrated in FIG. 3, from right to left which is the reverse direction of the spring force. Thus, this seal can be termed a reverse direction seal. Such spring force in one embodiment through simple calculations was determined to be 6.06 pounds. This is done through simple calculations of gas kinetic shear strength along with assumptions of flow rate of a gas and thus velocity and density. Since this is not believed to be a critical computation and relatively simple, it will not be shown.

After the initial gases have flowed into the cylinder chamber, the pressure will begin to build up to thousands of psi whereby alignment is less critical. This pressure acts on the end **38*a* of ring 38 and also the differential area exposed to the high pressure to force the seal into tighter engagement with exit port 31. The resultant force provided here is opposite the gas flow direction. It is also believed that the greater inner diameter of surface 39 compared to exit 31** enhances this "reverse" effect.

Thereafter, the circumferential expansion of the thinner wall at end **38*a* of the sealing ring 38 provides radial sealing of the ring with the wall of input port 16,17**. In operation, the invention can be characterized as a method which would have the following steps:

(1) A gas generator chamber, by the use of the turret head as illustrated in FIG. 3, is juxtaposed with the input port of a power cylinder.

(2) A sealing ring in the input port slides into spring engagement with the exit port of the gas generator chamber.

(3) This sealing ring is biased by a spring force so that when the gas generator is initiated it resists the initial friction force caused by the high pressure velocity gas flow in the opposite direction.

(4) The slidable sealing ring is biased against the exit port by a linear "reverse" force produced by the high pressure gas.

(5) The high pressure causes a circumferential expansion of the sealing ring to promote radial sealing.

(6) The annular grooves tend to restrict gas leakage due to created turbulence.

Thus, an improved dynamic seal and method therefor for a gas generator chamber has been provided. Moreover, this has been done in a way to minimize the cost and weight of the system since only one seal or obturator is required instead of one per power unit.

What is claimed:

1. In an electric circuit interrupter actuator a plurality of gas generator chambers each having an exit port having a high velocity gas flow therefrom;

a power cylinder for deriving mechanical energy for operating said circuit interrupter from said high velocity gas which develops a high gas pressure having an input port of similar configuration on said exit port;

means for successively juxtaposing one of said exit ports with said input port;

sealing means forming part of and slidable in said input port having an annular surface for sealing engagement with a said exit port and including spring means for biasing said surface against said exit port and providing a predetermined force greater than the frictional force created by said high velocity gas flow from said exit port whereby said sealing means operates and moves to seal in a direction opposite the flow of gas.

2. In an electric circuit interrupter actuator as in claim 1, where each of said gas generator chambers includes a chemical propellant cartridge contained in a metal cylinder which serves as a firing or pressure chamber and where its opening at the end opposite to that in which the cartridge is inserted is said exit port.

3. In an electric circuit interrupter actuator as in claim 1, where said sealing means is a slidable ring.

4. In an electric circuit interrupter actuator as in claim 1, where said spring means is a wave spring washer.

5. In an electric circuit interrupter actuator as in claim 2, where said cartridge contains no projectiles.

6. In an electric circuit interrupter actuator as in claim 3, where said ring includes a plurality of gas check grooves in its periphery whereby turbulence is created to retard the flow of gas between said ring and said input port.

7. In an electric circuit interrupter actuator as in claim 3, in which said ring is expandable in the presence of high pressure for radial sealing between said ring and said input port.

8. In an electric circuit interrupter actuator as in claim 7, wherein said ring has a tapered end for allowing radial expansion.

9. In an electric circuit interrupter actuator as in claim 1, where said annular surface of said sealing means includes a tapered edge for reducing the sealing surface area which engages said exit port whereby a higher sealing pressure is provided and the alignment of said sealing surface with said exit port is less critical.

10. In an electric circuit interrupter actuator as in claim 1, where the inner diameter of said sealing surface is greater than the inner diameter of said exit port.

11. A method of activating a power cylinder having an input port and which operates an electric circuit interrupter with the use of a plurality of gas generator chambers each having an exit port having a high velocity gas flow therefrom for developing a high gas pressure comprising the following steps:

(a) successively juxtaposing a said exit port of a gas generator chamber with said input port of said power cylinder;

(b) providing a sealing ring slidable in the input port having an annular surface at one end for sealing engagement with said exit port;

(c) biasing said slidable ring means with a spring force greater than the friction force caused by high velocity gas flow from said exit port when said juxtaposed gas generator is operated;

(d) and biasing said slidable ring by means of high pressure gas exerting a force on the other end of said ring to press it tightly against said exit port whereby a seal is ensured.

12. A method as in claim 11 including the additional last step of thereafter allowing circumferential expansion of the sealing ring as a result of said high pressure build-up for radial sealing between said ring and input port in the presence of significantly high pressure applied for activating said power cylinder.

* * * * *